US005195763A

United States Patent [19]

Scott et al.

[11] Patent Number: 5,195,763

[45] Date of Patent: Mar. 23, 1993

[54] CREEPER CUSHION

[75] Inventors: Walter B. Scott, Superior; David Salanda, Burlington, both of Wis.

[73] Assignee: Walter B. Scott, Superior, Wis.

[21] Appl. No.: 601,030

[22] Filed: Oct. 19, 1990

Related U.S. Application Data

[63] Continuation of Ser. No. 264,995, Oct. 31, 1988, abandoned.

[51] Int. Cl.[5] ..... B25H 5/00

[52] U.S. Cl. ..... 280/32.6; 297/DIG. 6

[58] Field of Search ..... 280/32.5, 32.6, 18; 297/219, 220, DIG. 6; 5/448, 470, 471, 417, 420; 428/71, 76, 102, 194, 246

[56] References Cited

U.S. PATENT DOCUMENTS

| | | | |
|---|---|---|---|
| 351,790 | 11/1886 | Paton | 280/18 |
| 1,104,398 | 7/1914 | Zimmerman | 280/32.6 |
| 2,576,455 | 11/1951 | Gratt | 5/354 |
| 2,596,547 | 5/1952 | Guest | 5/334 |
| 2,614,273 | 10/1952 | Yancofski | 5/354 |
| 2,843,391 | 7/1958 | Pelletier | 280/32.6 |
| 3,308,490 | 3/1967 | Cacioppo | 5/471 |
| 3,446,531 | 5/1969 | Froelich | 297/DIG. 6 |
| 3,479,046 | 11/1969 | Thompson | 280/18 |
| 3,982,748 | 9/1976 | Hooper et al. | 280/18 |
| 4,244,594 | 1/1981 | Hines | 280/32.6 |
| 4,260,440 | 4/1981 | Frankenberg | 5/501 |
| 4,317,244 | 3/1982 | Balfour-Richie | 5/449 |
| 4,405,142 | 9/1983 | Whetstine | 297/DIG. 6 |
| 4,450,193 | 5/1984 | Staebler | 428/71 |
| 4,549,323 | 10/1985 | Brockhaus | 5/455 |
| 4,624,022 | 11/1986 | Dolan | 5/508 |
| 4,658,452 | 4/1987 | Brockhaus | 5/420 |
| 4,671,568 | 6/1987 | Greer | 297/229 |
| 4,723,300 | 2/1988 | Aranow | 5/420 |
| 4,777,681 | 10/1988 | Lück et al. | 5/471 |

*Primary Examiner*—Mitchell J. Hill

*Attorney, Agent, or Firm*—Peterson, Wicks, Nemer & Kamrath

[57] ABSTRACT

A cushion for removable attachment to an automotive repair creeper is disclosed according to the preferred teachings of the present invention including a flexible insulator removably received within a flexible bag-like covering. The insulator in its preferred form includes first and second reflective layers sandwiching sealed, multiple air cell material. The reflective layers reflect body heat back and cold away from the mechanic. The air encapsulated in the air cells acts as insulation in reducing heat transfer and provides a resilient, cushion-type support. The cushion has a size and shape generally equal to and complementary to the top surface of the platform of the creeper between the longitudinal rails and is removably held thereon by fasteners which in the preferred form are VELCRO® fasteners secured to the bottom half of the covering and the top surface of the platform such as by double-sided adhesive tape whereby the insulator is located intermediate the platform and the mechanic laying thereon. Thus, the cushion may be secured to and removed from the creeper without the use of tools and without modification to the creeper.

20 Claims, 1 Drawing Sheet

CREEPER CUSHION

This is a continuation of copending application(s) Ser. No. 07/264,995 filed on Oct. 31, 1988, now abandoned.

BACKGROUND

The present invention generally relates to cushions for removable attachment to automotive repair creepers.

The use of automotive creepers upon which mechanics may lie and move themselves beneath automotive vehicles during servicing and repair have added to the ease and efficiency of movement of the mechanic. However, since creepers generally include a rigid platform, they are generally uncomfortable especially when laid upon for long periods of time. Further, as the mechanic is lying close to the floor, the mechanic is subject to cold drafts which are readily conducted through the creeper. Although mats have been provided in prior creepers, such mats were generally installed during manufacture of the creeper and often distracted from the overall comfort of the creeper due to the projections created by the fastening utilized such as a yoke member secured by rivets or bolts to the platform.

Thus, a need has arisen for a cushion which is removably attached to existing automotive repair creepers, which is securable and removable without the use of tools, which is free from projections which would detract from the comfort to the mechanic lying on the creeper, and which does not require modifications to the creeper to allow securement of the cushion thereto.

SUMMARY

The present invention solves this and other needs and problems in the field of automotive repair creepers by providing a cushion of a size generally equal to and complementary to the platform of the creeper which is releasably secured to the platform without the use of tools or modifications to the creeper and which is free of projections which would detract from the comfort to the mechanic when the cushion is intermediate the creeper and the mechanic when the mechanic is lying on the platform of the creeper.

In the preferred form, the cushion is removably secured to the creeper by fastener portions such as VELCRO ® hook and loop fasteners secured to the cushion and to the top surface of the platform of the creeper such that the cushion is intermediate the fastener portions and the mechanic lying on the creeper.

Additionally, in the preferred form, the creeper cushion includes a flexible insulator received within a flexible covering. In its most preferred form, the insulator includes first and second reflective layers sandwiching sealed, multiple air cell material. The reflective layers reflect body heat back to the mechanic and cold away from the mechanic. The air encapsulated in the air cells of the material acts as insulation in reducing heat transfer and provides a resilient, cushion-type support for the mechanic.

It is thus an object of the present invention to provide a cushion for removable attachment to a creeper.

It is further an object of the present invention to provide such a novel creeper cushion which is free from projections from the top surface of the creeper.

It is further an object of the present invention to provide such a novel creeper cushion which is securable without the use of tools.

It is further an object of the present invention to provide such a novel creeper cushion which is securable to existing creepers without modification.

It is further an object of the present invention to provide such a novel creeper cushion which does not require factory installation.

It is further an object of the present invention to provide such a novel creeper cushion which stops chills from entering the area of the back, buttocks, and upper legs of a mechanic.

It is further an object of the present invention to provide such a novel creeper cushion which reflects and retains body warmth.

It is further an object of the present invention to provide such a novel creeper cushion which is thin.

It is further an object of the present invention to provide such a novel creeper cushion which is flexible.

It is further an object of the present invention to provide such a novel creeper cushion which is comfortable.

It is further an object of the present invention to provide such a novel creeper cushion which does not detract from the comfort and aesthetic appearance to the mechanic.

It is further an object of the present invention to provide such a novel creeper cushion which provides a cushion-type support.

It is further an object of the present invention to provide such a novel creeper cushion which is moisture proof.

It is further an object of the present invention to provide such a novel creeper cushion which reflects cold away from the mechanic.

It is further an object of the present invention to provide such a novel creeper cushion which is not prone to being pulled up or down on the creeper by the movement of the mechanic.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
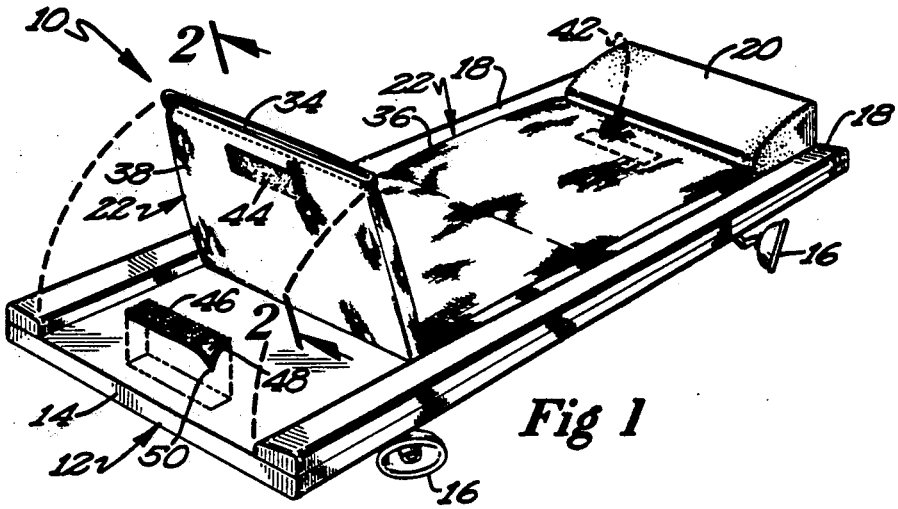
FIG. 1 shows an exploded perspective view of a creeper cushion according to the preferred teachings of the present invention, with portions being broken away.
Figure 2:
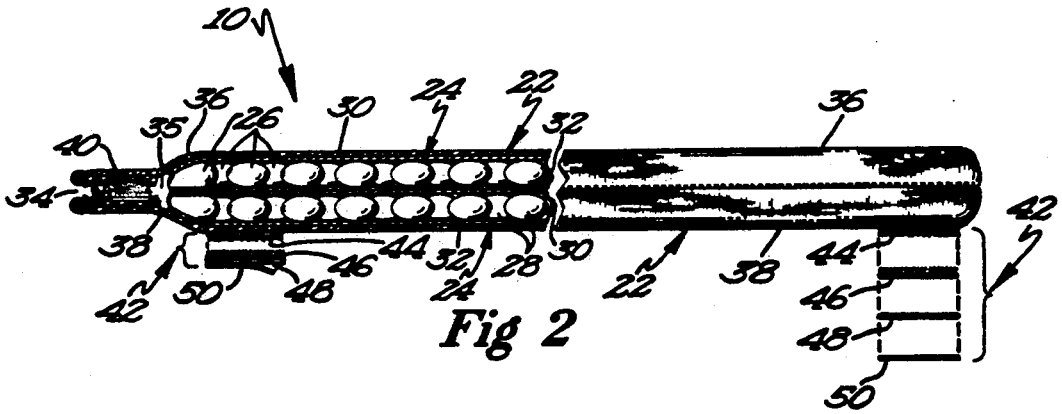
FIG. 2 shows a cross-sectional view of the creeper cushion of FIG. 1 according to section line 2—2 of FIG. 1.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "inside", "outside", "inner", "outer", "interior", and similar terms are used herein, it should be understood that these terms have reference only to the structure shown in the drawings as it would appear to a person viewing the drawings and are utilized only to facilitate describing the invention.

DESCRIPTION

A cushion for removable attachment to existing automotive repair creepers according to the preferred teachings of the present invention is shown in the drawings and is generally designated 10. Creeper 12 is generally a wheeled platform and includes a platform 14 of a size for laying thereon by mechanics and which is movably supported on the floor by casters 16. In the preferred form, longitudinal rails 18 are provided adjacent the sides of platform 14 to prevent the mechanic from accidentally sliding from platform 14. Further, in the preferred form, a pillow 20 is secured adjacent the top end of platform 14 to allow the mechanic to rest his head thereon while lying on platform 14.

Cushion 10 includes a flexible covering 22 and a laminated insulator 24. Insulator 24 is thin, soft, lightweight, flexible, cushiony, heat reflective, and moisture proof. Specifically, in the preferred form of the present invention, insulator 24 is formed of layers 26 and 28 of sealed, multiple air cell material sandwiched between first and second metalized plastic sheet or metallic foil or other reflective member or layers 30 and 32. It can then be appreciated that layers 26 and 28 are formed of plastic material and as such do not absorb or hold water. Similarly, layers 30 and 32 do not absorb or hold water. It can further be appreciated that the air encapsulated in layers 26 and 28 acts as an insulator in reducing heat transfer. Similarly, layers 26 and 28 provide a resilient, cushion-type support as the encapsuled air within layers 26 and 28 can be compressed to act in the manner of a shock absorber and spring. In the most preferred form, insulator 24 is one-fourth of an inch thick. In the preferred embodiment, two insulators 24 are utilized in an abutting relation in each cushion 10.

Flexible covering 22 is a bag-like component having an open top 34 for receipt of and enclosing insulator 24. Generally, covering 22 includes two halves 36 and 38 having a shape and size corresponding to but slightly larger than insulator 24. Halves 36 and 38 are joined by their side and bottom peripheries such as by stitching. Suitable provisions 40 such as VELCRO® hook and loop type fasteners may be provided for releasably closing open top 34 to allow removable placement of insulator 24 within interior 35 of covering 22.

In its most preferred form, covering 22 may be formed of flexible material such as fabric which can be stain and wear resistant, spark and flame resistant, washable, and comfortable to the touch of the skin of the wearer. In the most preferred form, covering 22 is formed of 100% cotton twill fabric such as 16 ounce denim.

Cushion 10 according to the teachings of the present invention has a shape corresponding to platform 14 and specifically to platform 14 between rails 18 and between pillow 20 and the bottom end of platform 14. In its most preferred form, cushion 10 is 33 inches (84 cm) long and 11½ inches (29 cm) wide. According to the teachings of the present invention, cushion 10 includes provisions 42 for releasably securing covering 22 to platform 14 to allow easy removal without the use of tools. Specifically, in its most preferred form, provision 42 is VELCRO® hook and loop-type fasteners and generally includes a first portion 44 which may be either the hook or loop fastener portion and a second portion 46 which may be the other of the hook or loop fastener portion and which is removably interconnectable to portion 44. In its most preferred form, portion 44 is permanently secured to half 38 of covering 22 such as by adhesive or sewing. Suitable provision 48 is further provided to permanently secure portion 46 to platform 14 of an existing creeper 12 such as double-sided adhesive tape having a first side adhered to portion 46 and a second side covered by a removable protective covering sheet 50. Thus, after sheet 50 has been removed from tape 48, the second side of tape 48 can be adhered to platform 14. In its most preferred form, two provisions 42 are provided extending laterally between rails 18 and generally parallel to and adjacent but spaced from pillow 20 and the bottom end of platform 14. Thus, provisions 42 releasably secure cushion 10 to platform 14. Cushion 10 has a thickness generally equal to the thickness of insulator 24, as the thickness of halves 36 and 38 is relatively small, and specifically has a thickness in the range of ⅝ inch (1.59 cm). Cushion 10 according to the teachings of the present invention is lightweight.

Now that the construction of cushion 10 according to the teachings of the present invention has been explained, the preferred uses and advantages of cushion 10 can be set forth and appreciated. Specifically, due to its thinness, cushion 10 may be positioned on platform 14 on existing creepers 12 between the rails 16 without bulkiness in a manner as shown in the drawings such that the mechanic may lay thereon and without a significant increase in the overall height of creeper 12. Particularly, cushion 10 according to the teachings of the present invention may be marketed separately from creeper 12 and can be applied to existing creepers 12 without modification thereto. Cushion 10 is not required to be assembled to creeper 12 during its manufacture and does not require modifications to present creepers 12 as bolts or the like extending through yolks or the like are not utilized.

It should then be appreciated that provisions 40 and 42 are advantageous. Specifically, provisions 40 and 42 are flat, flexible, soft, and thin such that they do not provide raised projections or obstructions from platform 14 when cushion 10 is removably secured to creeper 10. Further, as insulator 24 is located intermediate provisions 42 and 48 and the mechanic lying on creeper 12, insulator 24 acts as a buffer to the limited increase in thickness resulting from provisions 42 and 48. Similarly, it can be appreciated that provisions 42 and 48 are located intermediate the top surface of platform 14 of creeper 12 and half 38 of covering 22 and thus do not extend over or from the periphery or half 36 of covering 22 and rails 18, pillow 20, or the sides of creeper 12 in its most preferred form. It can then be appreciated that snaps, yoke members, bolts and other attachment devices would provide raised projections from platform 14 which would detract from the comfort when the mechanic is laying thereon and from the overall appearance of creeper 12. Further, cushion 10 can be easily removed from creeper 12 without the use of tools simply by pulling on cushion 10 separating portions 44 and 46. It can then be appreciated that due to the minimal presence of cushion 12 remaining, i.e. tape 48 and second portion 46 according to the teachings of the present invention, creeper 12 may be utilized with cushion 10 removed with minimal change in comfort, appearance and the like as creeper 12 prior to utilization of cushion 10 according to the teachings of the present invention.

According to the teachings of the present invention, layer 30 reflects the mechanic's body heat back to the mechanic and similarly, layer 32 reflects away the cold from platform 14 of creeper 12, the floor or the like. This feature maximizes the use of the mechanic's body heat in keeping the wearer warm. Further, with layers 26 and 28 of insulator 24, this feature also reduces the loss of the mechanic's body heat such that the mechanic's body heat is retained.

Covering 22 according to the teachings of the present invention adds comfort to the wearer as it covers insulator 24 and specifically layer 30 thereof such that layer 30 does not directly engage the mechanic's skin and clothing as layers 30 and 32 of insulator 24 may be abrasive to the mechanic's skin and outer garments. Further, covering 22 absorbs any perspiration of the mechanic and keeps insulator 24 from sticking to the mechanic's skin from such perspiration to provide added comfort. Additionally, due to the releasably closable nature of open top 34, covering 22 may be cleaned after insulator 24 is removed from interior 35 thereof.

Cushion 10 according to the teachings of the present invention protects the back, buttocks, and upper legs of the mechanic laying thereon from cold objects, winds and dampness and to thus keep these parts of the body warm, dry, and comfortable. Thus, cold chills are stopped from entering the mechanic's back, buttocks, and upper legs to avoid painful, sore, aching muscles induced by cold chills. This is especially important because the mechanic is lying adjacent cold floors or ground. Additionally, cushion 10 according to the teachings of the present invention cushions the mechanic in a laying position. Further, due to its lightweight, thin, and flexible nature, cushion 10 according to the teachings of the present invention may be comfortably utilized without restricting body movement. It can then be appreciated that cushion 10 according to the teachings of the present invention provides a synergistic combination for solving the problems associated with cold, damp, and/or windy conditions and/or associated with laying on the relatively hard surface of platform 14 of creeper 12.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. For use with a creeper including a rigid platform having a top end, a bottom end, and first and second sides around a top surface, with the mechanic lying on the top surface of the platform, the improvement comprising a cushion of a size generally equal to and complementary to the platform of the creeper, with the cushion including an upper surface and a lower surface, with the mechanic lying on the upper surface of the cushion and the lower surface being on the opposite side of the cushion than the upper surface; and means for releasably securing the lower surface of the cushion directly to the top surface of the platform without the use of tools or modification to the platform of the creeper, with the cushion being intermediate the mechanic and the platform when the mechanic is lying upon the creeper and with the releasably securing means being free of projections which would detract from the comfort to the mechanic lying on the creeper and upon the cushion.

2. The improvement of claim 1 wherein the cushion comprises, in combination: a flexible insulator received within a flexible covering; and wherein the releasably securing means comprises means for releaseably securing the flexible covering to the top surface of the platform.

3. The improvement of claim 2 wherein the insulator comprises, in combination: at least a first layer of sealed, multiple air cell material, with the air encapsulated in the air cells of the material acting as insulation in reducing heat transfer and providing a resilient, cushion type support; and at least a first reflective layer intermediate the air cell material and the mechanic for reflecting the body heat of the mechanic back to the mechanic.

4. The improvement of claim 3 wherein the insulator further comprises, in combination: a second reflective layer, with the first and second reflective layers sandwiching the layer of sealed, multiple air cell material, with the second reflective layer reflecting cold away from the layer of sealed, multiple air cell material and the mechanic.

5. The improvement of claim 4 wherein the covering comprises, in combination: a first half having a side periphery, a bottom periphery, and a top; and a second half having a side periphery, a bottom periphery, and a top, with the first and second halves being joined by their side and bottom peripheries to form a bag-like component defining an interior, with the insulator located within the interior of the bag-like component.

6. The improvement of claim 5 wherein the covering further comprises, in combination: means for removably securing the top of the first half to the top of the second half allowing the removeable placement of the insulator within the interior of the bag-like component.

7. The improvement of claim 6 wherein the flexible covering is formed of cleanable, wear resistant fabric which feels comfortable to the mechanic.

8. The improvement of claim 7 wherein the releasably securing means comprises a first fastener portion secured to the second half of the covering, with the lower surface of the cushion located on the second half of the covering; and a second fastener portion directly secured to the top surface of the platform of the creeper for removable interconnection to the first fastener portion, with the first and second fastener portions being flat and thin.

9. The improvement of claim 8 wherein the second fastener portion is secured to the platform by double-sided adhesive tape having a first adhesive side secured to the second fastener portion and a second adhesive side covered by a removable protective covering sheet and for securing to the top surface of the platform.

10. The improvement of claim 9 wherein the first and second fastener portions comprise hook and loop-type fasteners.

11. The improvement of claim 6 wherein the insulator is moisture proof and will not absorb moisture.

12. The improvement of claim 2 wherein the releasably securing means comprises a first fastener portion secured to the covering, with the lower surface of the cushion located on the covering; and a second fastener portion directly secured to the top surface of the platform of the creeper for removable interconnection to the first fastener portion, with the first and second fastener portions being flat and thin.

13. The improvement of claim 12 wherein the second fastener portion is secured to the platform by double-sided adhesive tape having a first adhesive side secured to the second fastener portion and a second adhesive side covered by a removable protective covering sheet and for securing to the top surface of the platform.

14. The improvement of claim 13 wherein the first and second fastener portions comprise hook and loop-type fasteners.

15. The improvement of claim 2 wherein the insulator is moisture proof and will not absorb moisture.

16. The improvement of claim 2 wherein the flexible covering is formed of washable, wear resistant fabric which feels comfortable to the skin of the person.

17. The improvement of claim 2 wherein the covering comprises, in combination: a first half having a side periphery, a bottom periphery, and a top; and a second half having a side periphery, a bottom periphery, and a top, with the first and second halves being joined by their side and bottom peripheries to form a bag-like component defining an interior, with the insulator located within the interior of the bag-like component.

18. The improvement of claim 17 wherein the covering further comprises, in combination: means for removably securing the top of the first half to the top of the second half allowing the removeable placement of the insulator within the interior of the bag-like component.

19. The improvement of claim 1 wherein the releasably securing means comprises a first fastener portion secured to the lower surface of the cushion; and a second fastener portion directly secured to the top surface of the platform of the creeper for removable interconnection to the first fastener portion, with the first and second fastener portions being flat and thin.

20. The improvement of claim 19 wherein the second fastener portion is secured to the platform by double-sided adhesive tape having a first adhesive side secured to the second fastener portion and a second adhesive side covered by a removable protective covering sheet and for securing to the top surface of the platform.

* * * * *